US012502572B1

(12) United States Patent
Chen

(10) Patent No.: US 12,502,572 B1
(45) Date of Patent: Dec. 23, 2025

(54) VERTICAL PLUG-IN WEIGHT PLATE DEVICE

(71) Applicant: Yongkang Qifeng Industry and Trade Co., Ltd., Zhejiang (CN)

(72) Inventor: Huiguan Chen, Zhejiang (CN)

(73) Assignee: Yongkang Qifeng Industry and Trade Co., Ltd., Zhejiang (CN)

( * ) Notice: Subject to any disclaimer, the term of this patent is extended or adjusted under 35 U.S.C. 154(b) by 0 days.

(21) Appl. No.: 19/073,599

(22) Filed: Mar. 7, 2025

(51) Int. Cl.
*A63B 21/072* (2006.01)
*A63B 21/075* (2006.01)

(52) U.S. Cl.
CPC ..... *A63B 21/0728* (2013.01); *A63B 21/075* (2013.01)

(58) Field of Classification Search
CPC ..... A63B 21/0728; A63B 21/072–075
See application file for complete search history.

(56) References Cited

U.S. PATENT DOCUMENTS 7,182,716 B1 * 2/2007 Dawson ..... A63B 21/072 482/107
8,007,415 B1 * 8/2011 Lundquist ..... A63B 21/075 482/107
10,918,931 B2 * 2/2021 Myre ..... A63B 21/0726
11,052,276 B1 * 7/2021 Baker ..... A63B 21/0604
2006/0240958 A1 * 10/2006 Liu ..... A63B 21/0728 482/107
2007/0225132 A1 * 9/2007 Liu ..... A63B 21/075 482/106
2010/0190618 A1 * 7/2010 Chen ..... A63B 21/075 482/108
2012/0021877 A1 * 1/2012 Lundquist ..... A63B 21/0728 482/107
2022/0257993 A1 * 8/2022 Geng ..... A63B 21/0728
2024/0285995 A1 * 8/2024 Cheng ..... A63B 21/0728
2025/0025738 A1 * 1/2025 Li ..... A63B 21/0726

* cited by examiner

*Primary Examiner* — Megan Anderson
*Assistant Examiner* — Catrina A Letterman
(74) *Attorney, Agent, or Firm* — Hawaii Patent Services; Nathaniel K. Fedde; Kenton N. Fedde

(57) ABSTRACT

This invention relates to a vertical plug-in weight plate device, which aims to address the issues of inconvenient weight adjustment and low flexibility in the use of existing weight plate devices. The weight plate device includes a handle, a weight plate, and a knob with a limiting rod. Fixed plates are located at both ends of the handle, and these fixed plates and the handle form a longitudinal plug-in channel through a through-hole structure. The center of the weight plate features a through-hole and an installation slot. The limiting rod fits into the through-hole to achieve longitudinal positioning. Meanwhile, the limiting surface of the knob aligns with the installation slot width to complete the lateral locking. The knob contains an elastic snap-fit structure, and a button drives the positioning protrusion to form a secondary lock with the positioning hole of the weight plate, ensuring stability during use. This solution enables tool-free quick disassembly of the weight plate and offers multi-gradient weight adjustment. Additionally, the use of longitudinal plug-in and dual-locking mechanisms significantly improves safety and operational efficiency. It is particularly suitable for high-intensity training scenarios.

10 Claims, 18 Drawing Sheets

VERTICAL PLUG-IN WEIGHT PLATE DEVICE

TECHNICAL FIELD

The present invention pertains to the field of fitness equipment technology, and more specifically, it relates to a vertical plug-in weight plate device.

BACKGROUND TECHNOLOGY

The vertical plug-in weight plate device is a piece of equipment designed to assist in fitness exercises and strength training. Its primary aim is to improve the convenience and safety of fitness routines.

Traditional adjustable weight plate devices typically rely on threaded tightening or pin locking methods for weight adjustment. However, these methods suffer from low efficiency and poor stability. Although commercially available plug-in weight plate devices improve disassembly speed with clasp mechanisms, they generally face several technical challenges: most products rely on a single clasp for securing the weight plates, which can easily detach due to vibrations during intense exercise, posing a risk of the equipment falling; existing rotational locking mechanisms, such as those in US20230271050A1, use a rotating handle for adjustment, but a slight movement of the handle at a non-locking angle can accidentally trigger the unlocking mechanism, leading to the risk of the weight plate falling off; to prevent this, some solutions, like US20240042264A1, add separate safety components, resulting in an increase in the number of components, higher maintenance costs, and a reduction in user experience due to multi-step operations.

Therefore, it is essential to develop a new type of weight plate device that not only ensures stable connections but also enhances quick assembly and disassembly, while minimizing the risk of accidental operation.

Invention Content

The present invention provides a vertical plug-in weight plate device to address the problems raised in the background art.

To achieve the above-mentioned objectives, the present invention adopts the following technical solution:

The invention optimizes the connection structure between the handle and the weight plate to enable quick weight adjustment and secure locking. The two ends of the handle body are welded with fixing plates. These fixing plates form an interlocking fit with the weight plate via a through-hole and installation slot. The central through-hole of the weight plate extends into both a long and a short slot. The short slot contains a second connector with a limiting slot and positioning slot. A limiting rod of the knob is inserted through the through-hole. Its limiting surface matches the width of the weight plate's installation slot, restricting longitudinal movement. The knob incorporates an elastic snap-fit structure inside its body. A button drives a positioning protrusion to disengage from or engage with the positioning hole on the weight plate, forming a secondary mechanical lock. The weight of the weight plate is adjusted by adding or removing plates and through-holes. For disassembly, simply press the button and rotate the knob 90°, aligning the limiting surface parallel to the installation slot. This allows for vertical removal or placement of the weight plate. The structure eliminates assembly gaps and prevents micro-movement wear. Additionally, the handle features an anti-slip texture or a replaceable silicone sleeve for improved grip comfort. By using a vertical plug-in design and a dual-locking mechanism, this invention enables one-touch operation while ensuring sufficient load-bearing strength. This significantly enhances training efficiency and safety, meeting individual fitness needs.

The advantages of the present invention over the prior art are as follows:

The vertical plug-in weight plate device, during use, limits the weight plates to only be loaded and unloaded along the vertical direction through the interconnecting components between the individual weight plates. This effectively prevents accidental detachment caused by lateral displacement. Additionally, the knob is connected to the outermost weight plate through a locking assembly. Its dual-locking mechanism ensures that the device remains securely fastened, even under long-term, high-frequency usage. Moreover, the core operating mechanism adopts an integrated linkage design, where the user only needs to rotate the central connecting rod to simultaneously complete the quick assembly or disassembly of all the weight plates. This not only guarantees the safety of the equipment but also simplifies the operation of the device, thereby enhancing training efficiency.

It should be noted that the present invention is not limited to dumbbells. The core design concept, which allows for quick and secure weight adjustment through a specific connection structure, can also be applied to barbells and kettlebells. For barbells, the vertical plug-in structure can be used for connecting the weight plates to the barbell rod, enabling rapid plate changes and precise positioning to meet varying training intensity requirements. For kettlebells, the connection structure can be modified to integrate vertical plug-in technology with the unique shape of the kettlebell, allowing for flexible weight adjustment without altering the feel of the kettlebell during use. This application extension enables the technology to bring innovation and transformation to a broader range of fitness equipment, catering to the diverse training needs of fitness enthusiasts.

DESCRIPTION OF THE DRAWINGS

The drawings that form part of this application are provided to further illustrate and enhance the understanding of the present invention. The exemplary embodiments and their explanations are intended to explain the invention and are not to be construed as limiting the scope of the invention. In the drawings.

Figure 1:
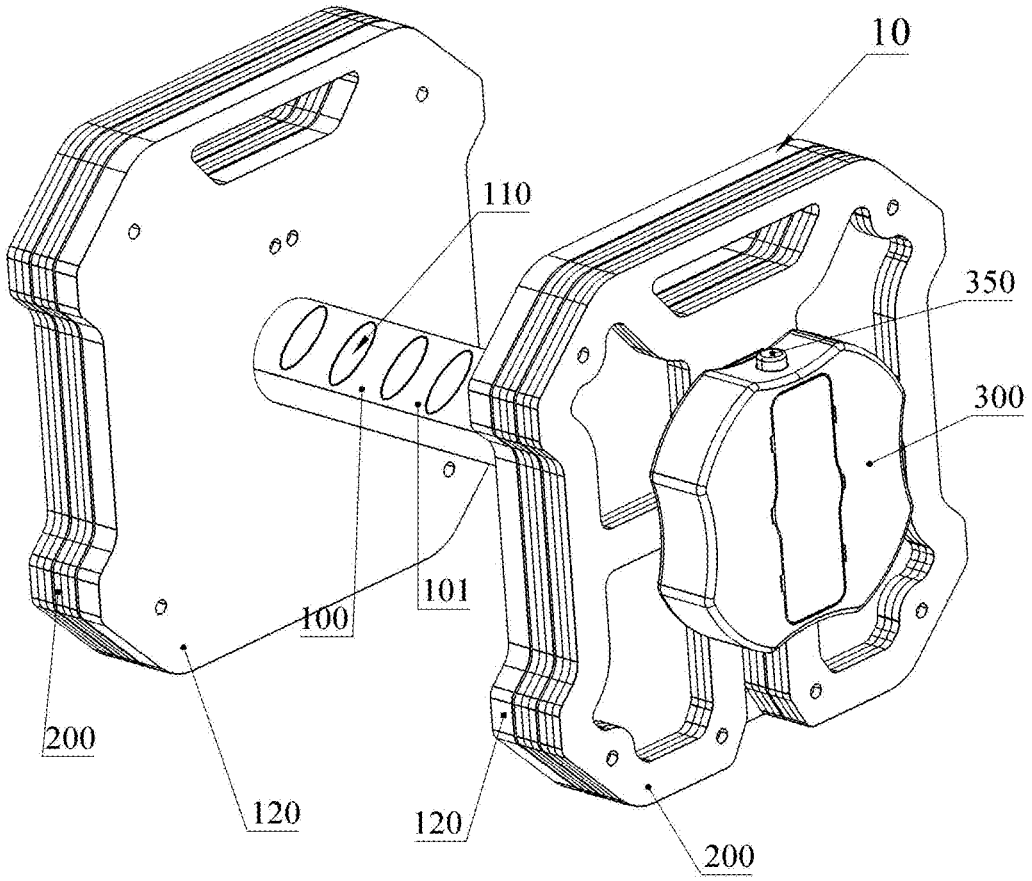
FIG. 1 is a perspective schematic diagram of an embodiment provided by the present invention.

Reference Numerals: Vertical Plug-in Weight Plate Device (10); Handle (100); Main Body (101); First Through-hole (102); Channel (1021); Anti-slip Texture (110); Fixing Plate (120); Second Through-hole (121); Installation Cavity (122); First Connector (130); Shared Wall (131); First Insert Plate (132); Stop Plate (133); Snap-fit Slot (134); Weight Plate (200); Through Hole (201); Lower Edge (202); Third Through-hole (210); Installation Slot (220); Long Slot (221); Short Slot (222); Second Connector (230); Second Insert Plate (231); Positioning Block (232); Receiving Slot (233); Common Wall (2321); Limiting Plate (2322); Positioning Plate (2323); Positioning Hole (2324); Limiting Slot (2325); Positioning Slot (2326); Fastener (240); Knob (300); Main Body (310); Sliding Cavity (311); Bottom Surface of Sliding Cavity (3111); Limiting Rod (320); First Limiting Surface (321); Second Limiting Surface (322); First Arc Surface (323); Second Arc Surface (324); Snap-fit Structure (340); Third Insert Plate (341); Positioning Protrusion (342); Rear Wall Surface (3421); Slope Surface (3422); Button (350); Reverse Slope (351); Elastic Component (360).

SPECIFIC EMBODIMENTS

The following description will provide a clear and complete explanation of the technical solution in the embodiments of the present invention, with reference to the accompanying drawings. Clearly, the described embodiments are part of the embodiments of the present invention, and not all of the embodiments. The description of at least one exemplary embodiment below is for illustrative purposes only and is not intended to limit the present invention or its applications or uses in any way. Based on the embodiments of the present invention, all other embodiments that a person skilled in the art can derive without performing inventive labor are within the scope of protection of the present invention.

It should be noted that the terms used here are for the purpose of describing the specific embodiments and are not intended to limit the exemplary embodiments of the present application. As used herein, unless the context explicitly indicates otherwise, the singular form is also intended to include the plural form. Furthermore, it should be understood that when the terms "comprising" and/or "including" are used in this specification, they indicate the presence of features, steps, operations, devices, components, and/or their combinations.

Unless otherwise specifically stated, the relative arrangement, numerical expressions, and values of the components and steps described in these embodiments do not limit the scope of the present invention. At the same time, it should be understood that, for ease of description, the dimensions of the various parts shown in the drawings are not drawn to scale. Known technologies, methods, and equipment in the related field may not be discussed in detail; however, where appropriate, these technologies, methods, and equipment should be considered part of the enabling disclosure. In all the examples shown and discussed here, any specific values should be interpreted as exemplary and not as limiting. Therefore, other exemplary embodiments may have different values. It should be noted that similar reference numerals and letters in the following drawings represent similar items, so once an item is defined in one drawing, further discussion of it in subsequent drawings is unnecessary.

In the present invention, addressing the issues of inconvenient weight adjustment and low flexibility in the use of weight plate devices in the prior art, a Vertical Plug-in Weight Plate Device is provided. This device not only enables quick weight adjustments but also ensures safety and stability during exercise. The following detailed description of the embodiment of the Vertical Plug-in Weight Plate Device of the present invention will be made with reference to the accompanying drawings.

Figure 2:
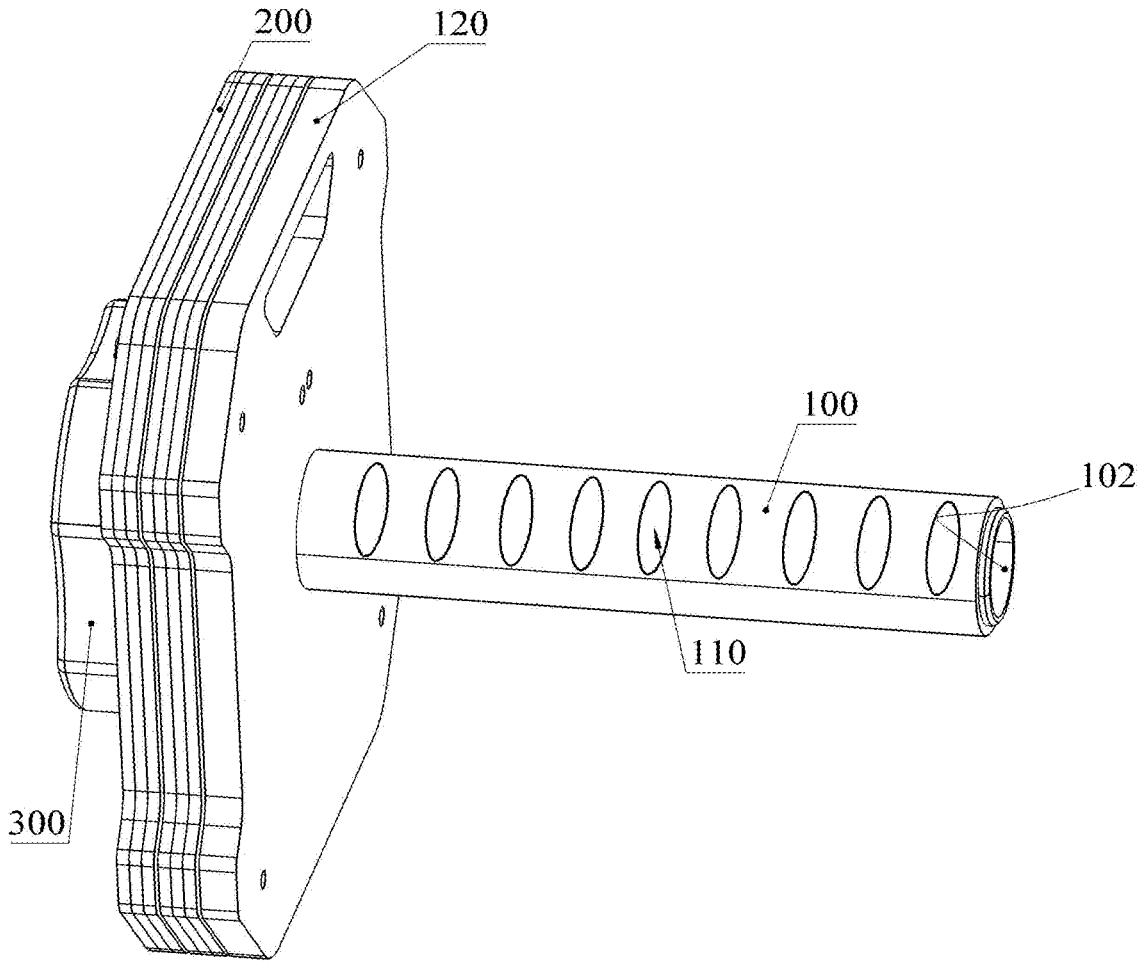
FIG. 2 is a structural schematic diagram of the embodiment in FIG. 1 after removing the right-side weight plate and knob.
Figure 11:
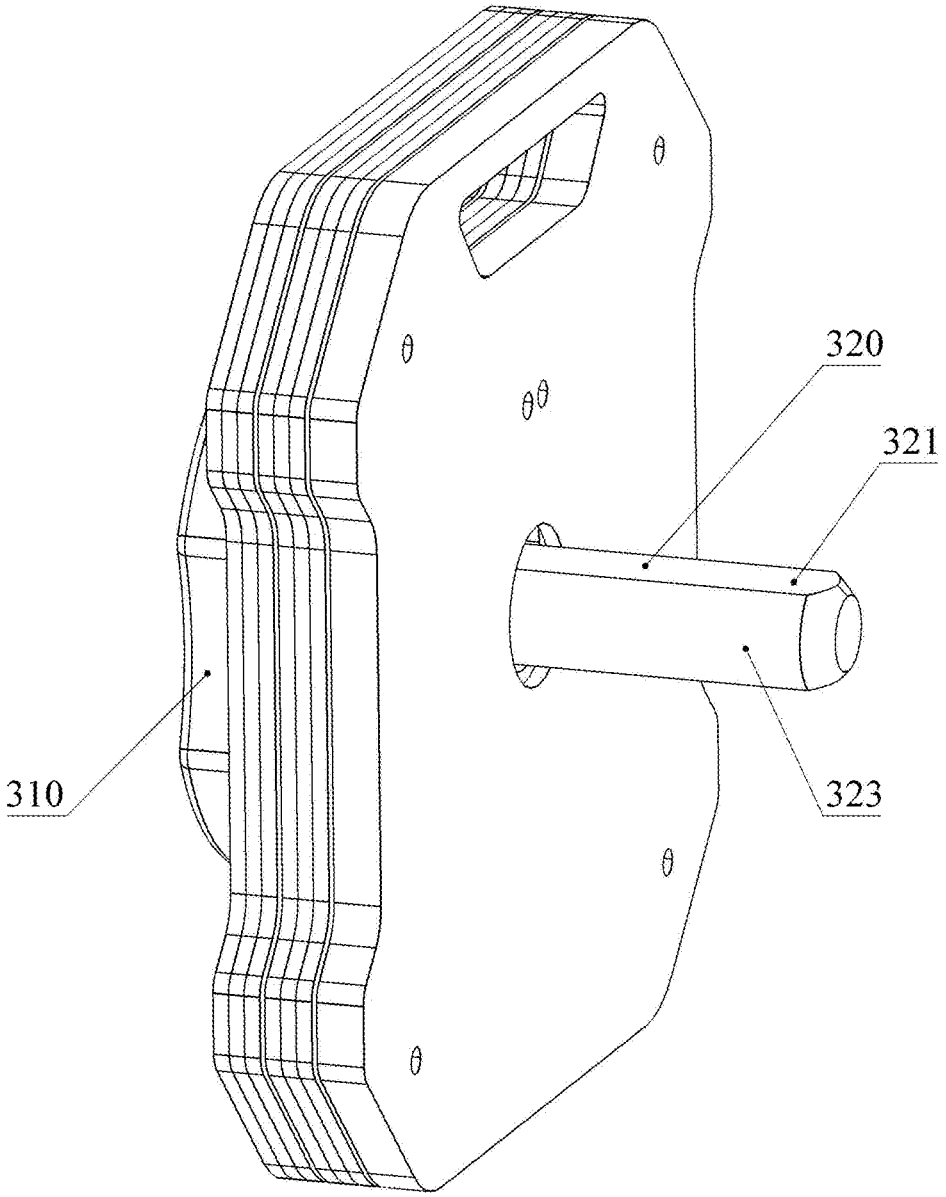
FIG. 11 is a schematic diagram of the connection between the knob and the weight plate in the embodiment shown in FIG. 1.

Referring to FIGS. 1 and 2, the Vertical Plug-in Weight Plate Device 10 of this embodiment includes a handle 100, a weight plate 200, and a knob 300 with a limiting rod 320 (see FIG. 11). The handle 100 has a hollow interior and open ends, with the main body 101 being of a certain length to facilitate single-hand or two-hand gripping by the user. The handle 100 features a cylindrical outer surface, and the surface is provided with an anti-slip texture 110, which is evenly distributed across the handle's surface. This anti-slip texture increases the friction when gripping, preventing the weight plate device from slipping out of the user's hands due to sweat or fatigue during high-intensity training.

In other embodiments (not shown in the drawings), the shape of the handle 100 can be modified to a regular polygon, an elliptical shape, or a biomimetic ergonomic curve according to the user's preference. This allows for a more comfortable grip and improved training effectiveness. For instance, recessed areas can be designed for each finger, allowing them to naturally fit into the corresponding recesses during the grip. This design ensures that the entire palm can apply force more efficiently. Additionally, the handle 100 may also adopt a telescopic sleeve structure, enabling segmented length adjustment (e.g., five levels) through an internal ratchet mechanism to meet different training movement requirements. Regarding the anti-slip design, the anti-slip texture 110 can be replaced with a detachable silicone anti-slip sleeve. This sleeve, when installed on the handle 100's outer surface, increases friction while providing a soft, comfortable feel.

As shown in FIG. 1, a fixing plate 120 is welded at both ends of the handle 100. A first through-hole 102, extending along the length direction of the handle 100, is provided at both ends of the handle 100 (see FIG. 2). The welded connection between the fixing plate 120 and the handle 100 ensures the structural load-bearing reliability, particularly suitable for high-frequency, heavy-load strength training scenarios. As an alternative (not shown in the figure), the handle 100 and fixing plate 120 may also adopt other forms of fixed connection, such as using bolts to secure the handle 100 to the fixing plate 120. Regardless of the connection method, the key is to establish a fixed connection between the fixing plate 120 and the handle 100.

Figure 3:
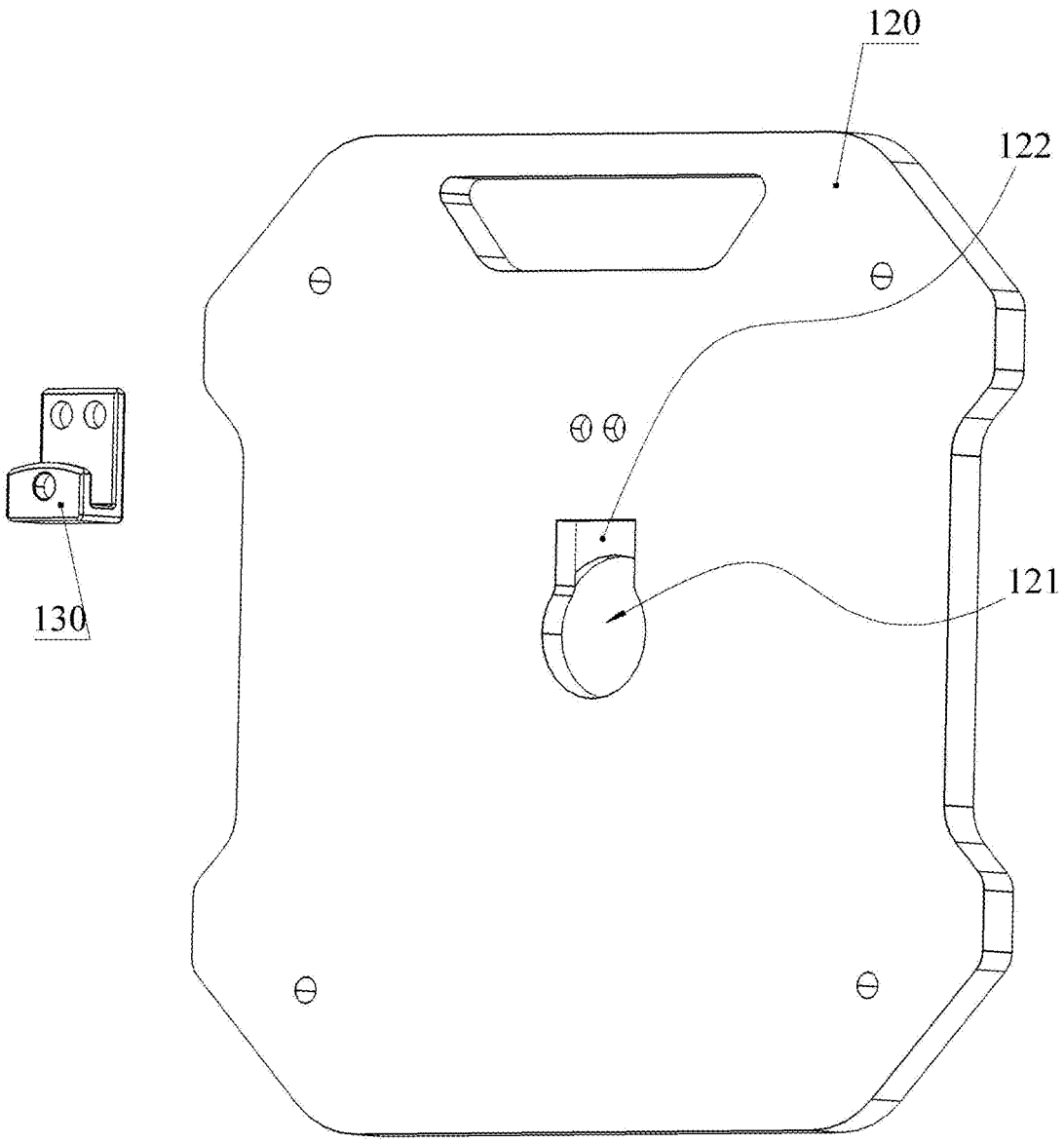
FIG. 3 is a structural schematic diagram of the fixing plate of the embodiment shown in FIG. 1.

Referring to FIGS. 2 and 3, in this embodiment, a second through-hole 121 is formed in the center of the fixing plate 120, and its diameter is consistent with the first through-hole 102 of the handle 100. When the fixing plate 120 is welded to the end of the handle 100, the first through-hole 102 and the second through-hole 121 align.

Figure 4:
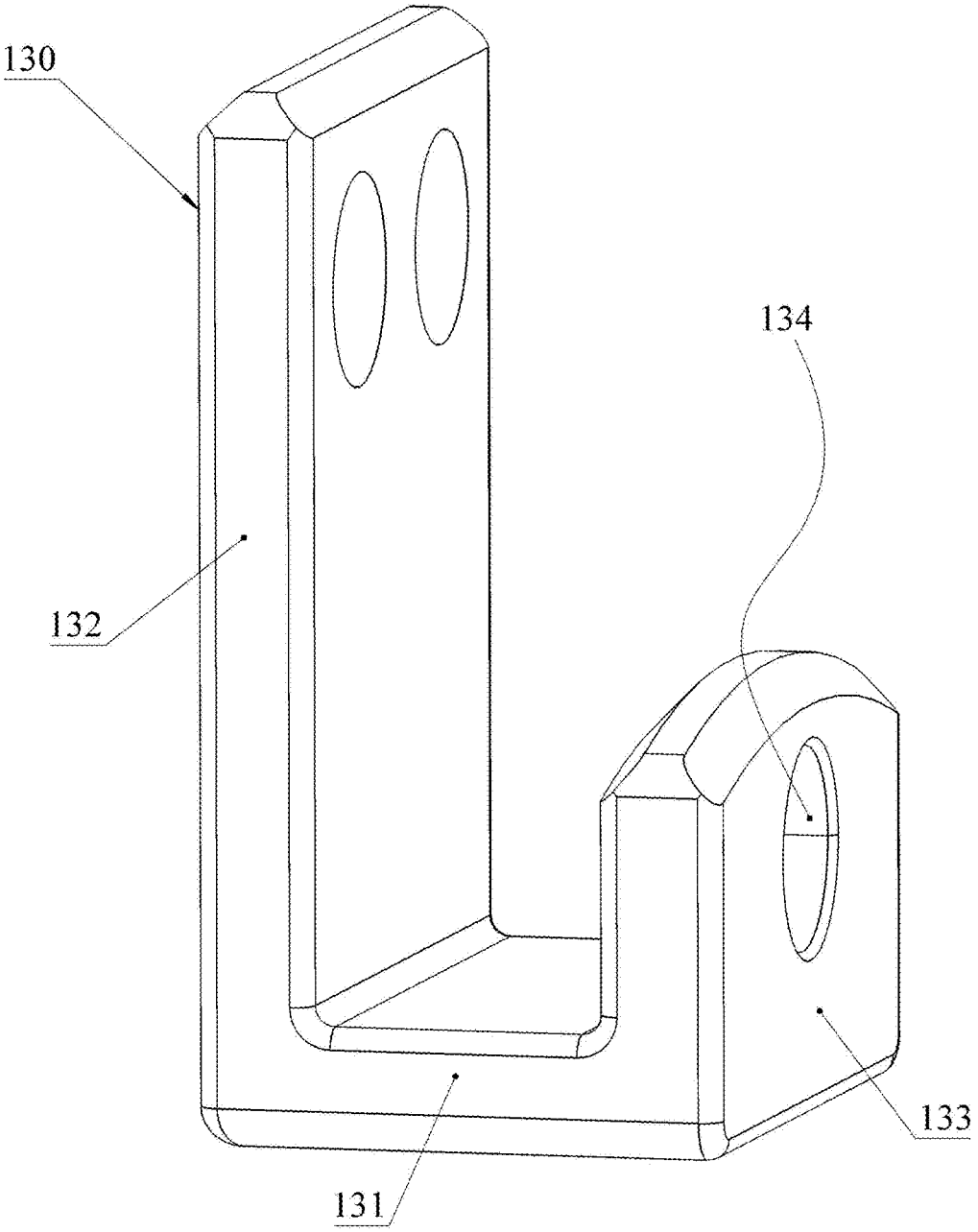
FIG. 4 is a perspective view of the first connector in the embodiment shown in FIG. 3.

As shown in FIGS. 3 and 4, an installation cavity 122 is formed inside the fixing plate 120. The first connector 130 includes a shared wall 131, as well as a first insert plate 132 and a stop plate 133, which extend from the shared wall 131. Between the first insert plate 132, the shared wall 131, and the stop plate 133, a "U"-shaped snap-fit slot 134 is formed. The first insert plate 132 is inserted into the installation cavity 122 and secured with bolts inside the cavity, so that the first connector 130 is firmly installed onto the fixing plate 120.

In other embodiments (not shown in the drawings), the installation cavity 122 and the first insert plate 132 may be eliminated. In this case, the first connector 130 is integrated into the fixing plate 120, with the shared wall 131 and stop plate 133 radially extending from the center of the fixing plate 120. This structure forms the "U"-shaped snap-fit slot 134 between the fixing plate 120, shared wall 131, and stop plate 133. By eliminating the assembly gap of traditional plug-in connections, this design effectively prevents micro-motion wear issues caused by high-frequency usage.

Figure 5:
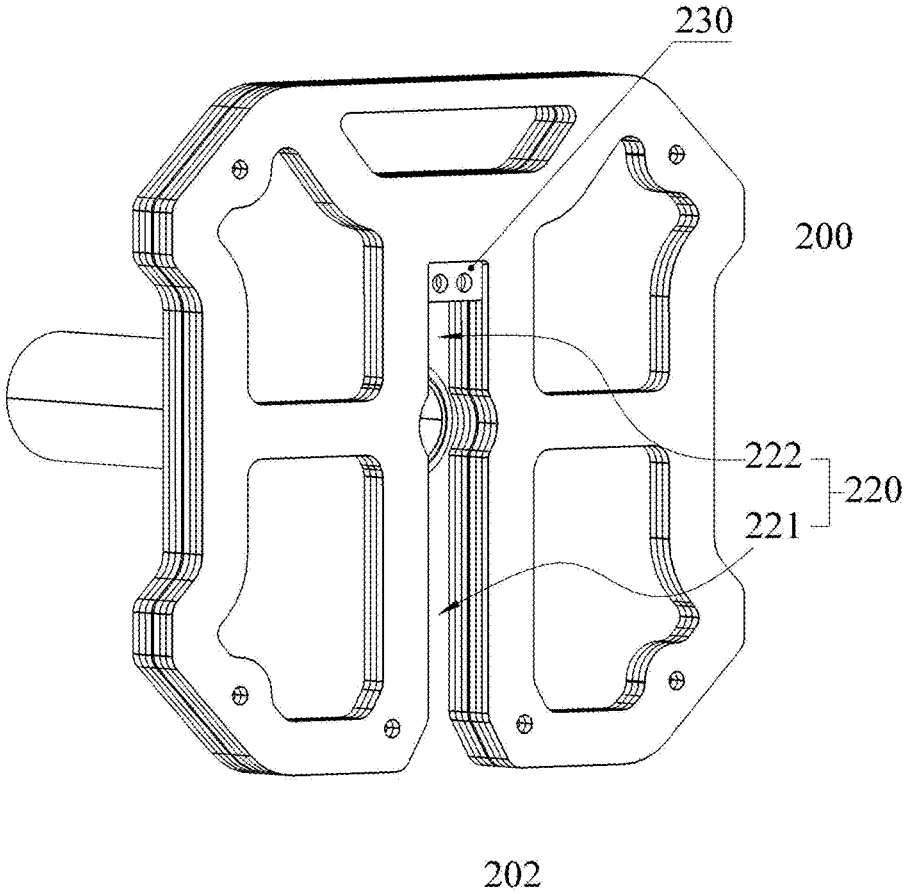
FIG. 5 is a perspective view of the weight plate in the embodiment shown in FIG. 1.
Figure 6:
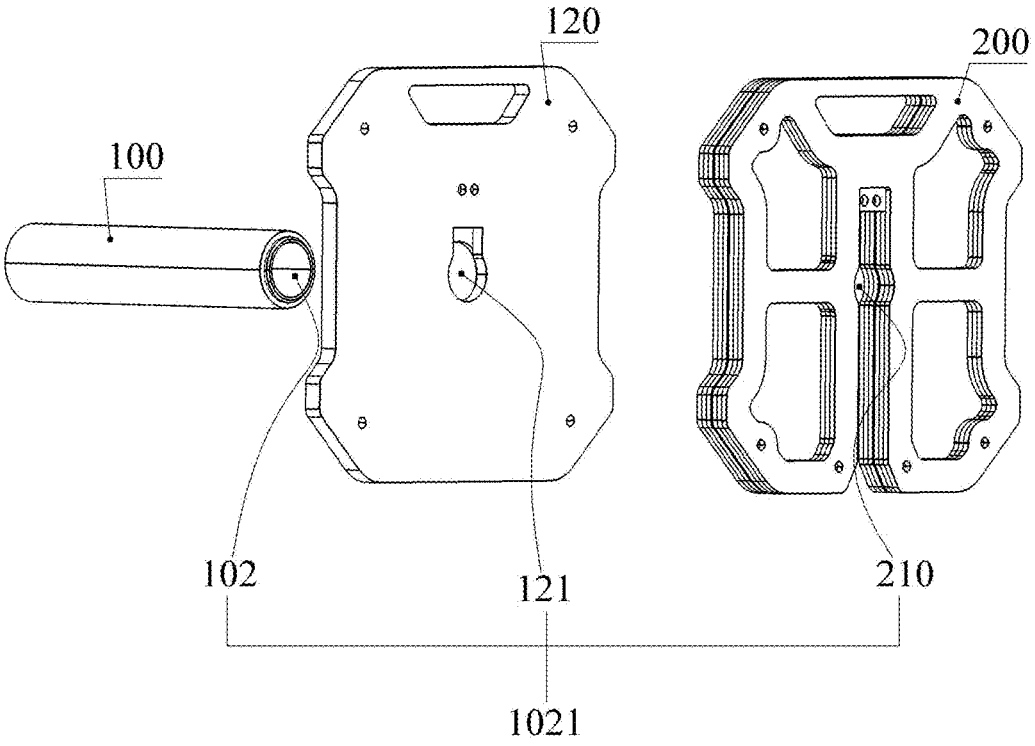
FIG. 6 is a schematic diagram of the connection between the handle, fixing plate, and weight plate in the embodiment shown in FIG. 1.
Figure 7:
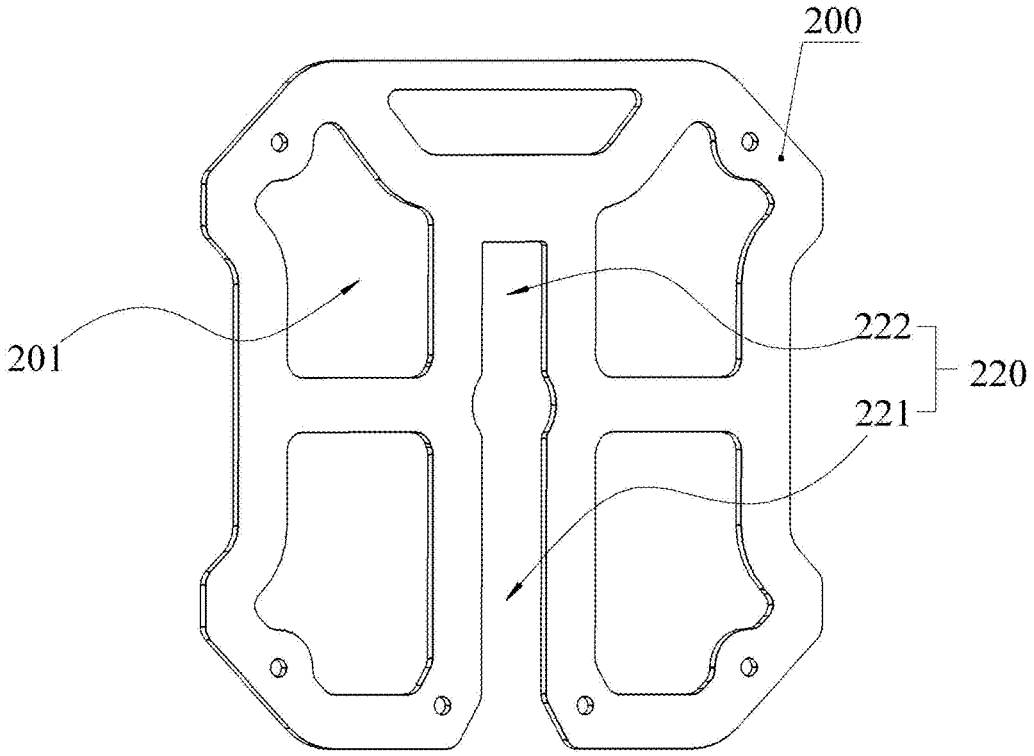
FIG. 7 is another perspective view of the weight plate in the embodiment shown in FIG. 6.

Referring to FIGS. 5-7, in this embodiment, the outer profile of the weight plate 200 is substantially the same as that of the fixing plate 120, ensuring a gapless fit during assembly. The weight plate 200 may also feature varying numbers of through-holes 201. By adjusting the number of through-holes 201, the mass gradient of the weight plate can be precisely controlled, offering users more weight options. In some embodiments, the surface of the weight plate 200 is laser-etched with a QR code, with an etching depth ranging from 0.05 mm to 0.1 mm. This QR code contains information such as weight parameters, production batch, and material composition. Alternatively, the QR code can be replaced by a micro RFID chip embedded at the edge of the weight plate, which stores data such as weight, center of mass coordinates, and usage history.

In other embodiments (not shown in the figures), the fixing plate 120 may also have alternative shapes, such as square, circular, or diamond, or any other desired form.

As shown in FIGS. 5 and 6, the center of the weight plate 200 is provided with a third through-hole 210. The third through-hole 210 has a diameter substantially the same as that of the first through-hole 102 and the second through-hole 121. The third through-hole 210 extends into an installation slot 220 at both ends facing opposite sides of the weight plate 200. One end of the installation slot 220 penetrates through the lower edge 202 of the weight plate 200, forming a long slot 221. The long slot 221 passes through the edge of the plate to create an open guide channel design, which facilitates the radial insertion of the limiting rod 320 of the knob 300 (see FIG. 11). The other end of the installation slot 220 terminates at the weight plate 200 and forms a short slot 222. The slot widths W1 of both the long slot 221 and the short slot 222 are not greater than the diameter of the third through-hole 210. Therefore, when the limiting rod 320 is inserted through the third through-hole 210, it can restrict the movement of the weight plate 200 along the vertical direction relative to the length of the limiting rod 320, i.e., in the longitudinal direction away from the limiting rod 320.

Figure 8:
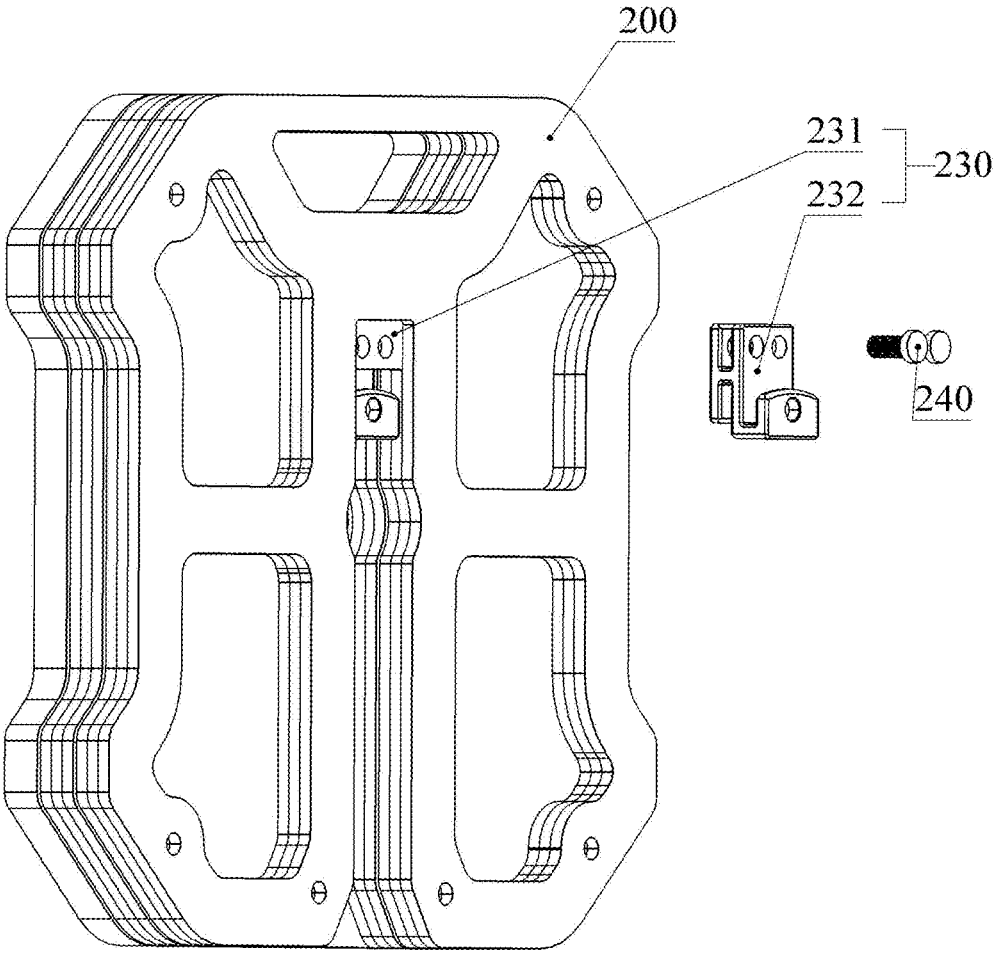
FIG. 8 is an exploded schematic diagram of the weight plate and the second connector in the embodiment shown in FIG. 1.
Figure 9:
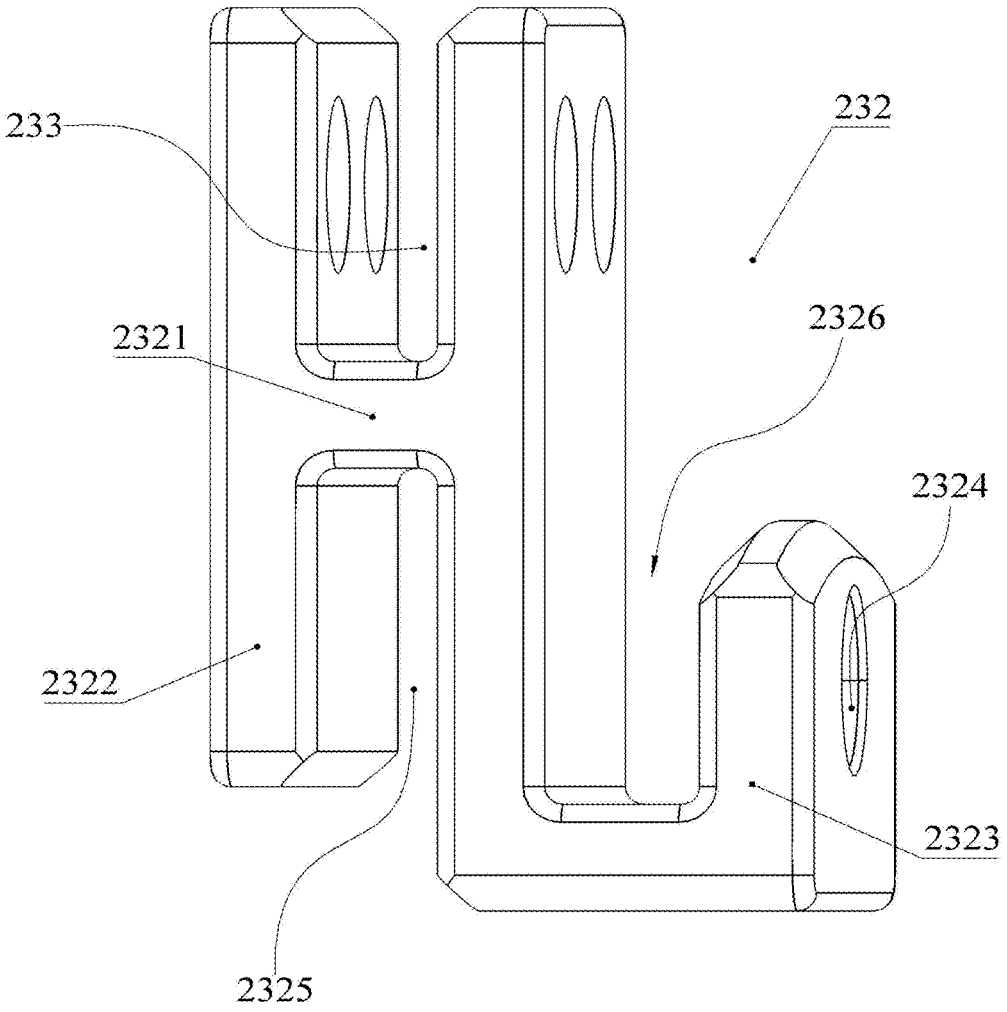
FIG. 9 is a perspective view of the second connector in the embodiment shown in FIG. 8.

As shown in FIGS. 8 and 9, the short slot 222 is provided with a second connector 230. In this embodiment, the second connector 230 includes a second insert plate 231 and a positioning block 232. The second insert plate 231 is positioned within the short slot 222 and extends from the short slot 222 towards the long slot 221. The positioning block 232 includes a receiving slot 233, which is formed at the upper end of the second connector 230. The second insert plate 231 is inserted into the receiving slot 233 and is fixedly connected to the positioning block 232 by a fastener 240. In this embodiment, the fastener 240 is a bolt.

As shown in FIG. 9, the positioning block 232 further includes a common wall 2321, as well as a limiting plate 2322 and a positioning plate 2323 extending from the common wall 2321. The positioning plate 2323 also has a positioning hole 2324. Between the limiting plate 2322 and the common wall 2321, a reversed "U"-shaped limiting slot 2325 is formed, and between the positioning plate 2323 and the common wall 2321, a "U"-shaped positioning slot 2326 is formed. The inner wall of the limiting slot 2325 is provided with an array of staggered protrusions, which are designed to enhance frictional locking with the snap-fit slot 134 or the positioning slot 2326.

Figure 10:
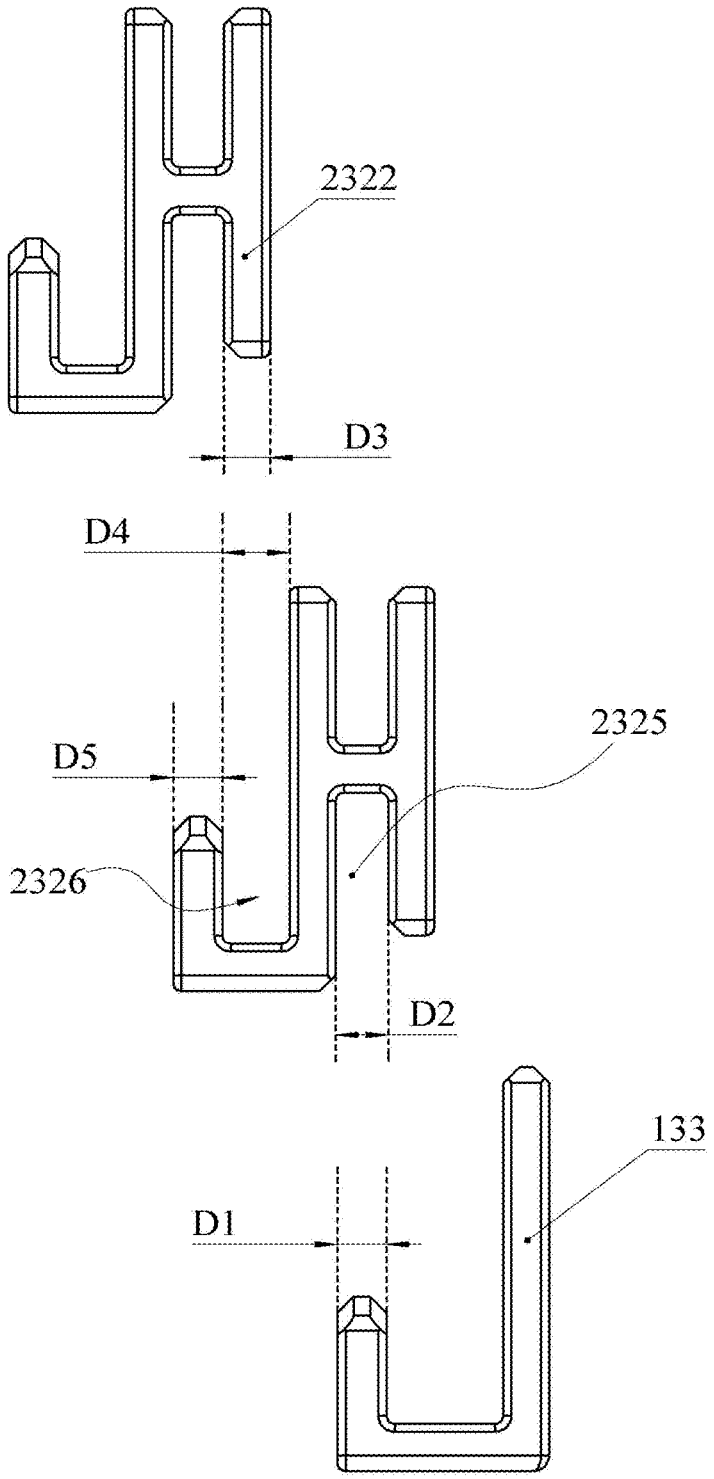
FIG. 10 is a front view of the first connector and second connector in the embodiment shown in FIG. 1.

Referring to FIG. 10, the thickness D1 of the stop plate 133 is the same as the slot width D2 of the limiting slot 2325. When the first connector 130 and the second connector 230 form a lateral interlocking, the stop plate 133 and the limiting slot 2325 form a transitional fit. The thickness D3 of the limiting plate 2322 is the same as the slot width D4 of the positioning slot 2326, and the thickness D5 of the positioning plate 2323 is the same as the slot width D2 of the limiting slot 2325. When the two weight plates 200 form a lateral interlocking through the second connector 230, a transitional fit is formed between the limiting plate 2322 and the positioning slot 2326, and between the positioning plate 2323 and the limiting slot 2325.

In other embodiments (not shown in the figures), the fastener 240 is not limited to a bolt structure but can also utilize a spring pin to replace the bolt, achieving tool-free quick disassembly through self-locking with the pin. The built-in elastic component can automatically compensate for assembly gaps and eliminate axial play during movement. A snap-fit structure may also be used, where an elastic snap-fit is provided on the sidewall of the positioning block 232, utilizing the material deformation characteristics to achieve instantaneous locking between the weight plate 200 and the second connector 230. Alternatively, the weight plate 200 and the second connector 230 may be integrally formed, with the common wall 2321, limiting plate 2322, and positioning plate 2323 directly cast into the body of the weight plate 200. This can involve extending the common wall 2321, limiting plate 2322, and positioning plate 2323 downward directly from the short slot 222 to form the limiting slot 2325 and positioning slot 2326.

Figure 12:
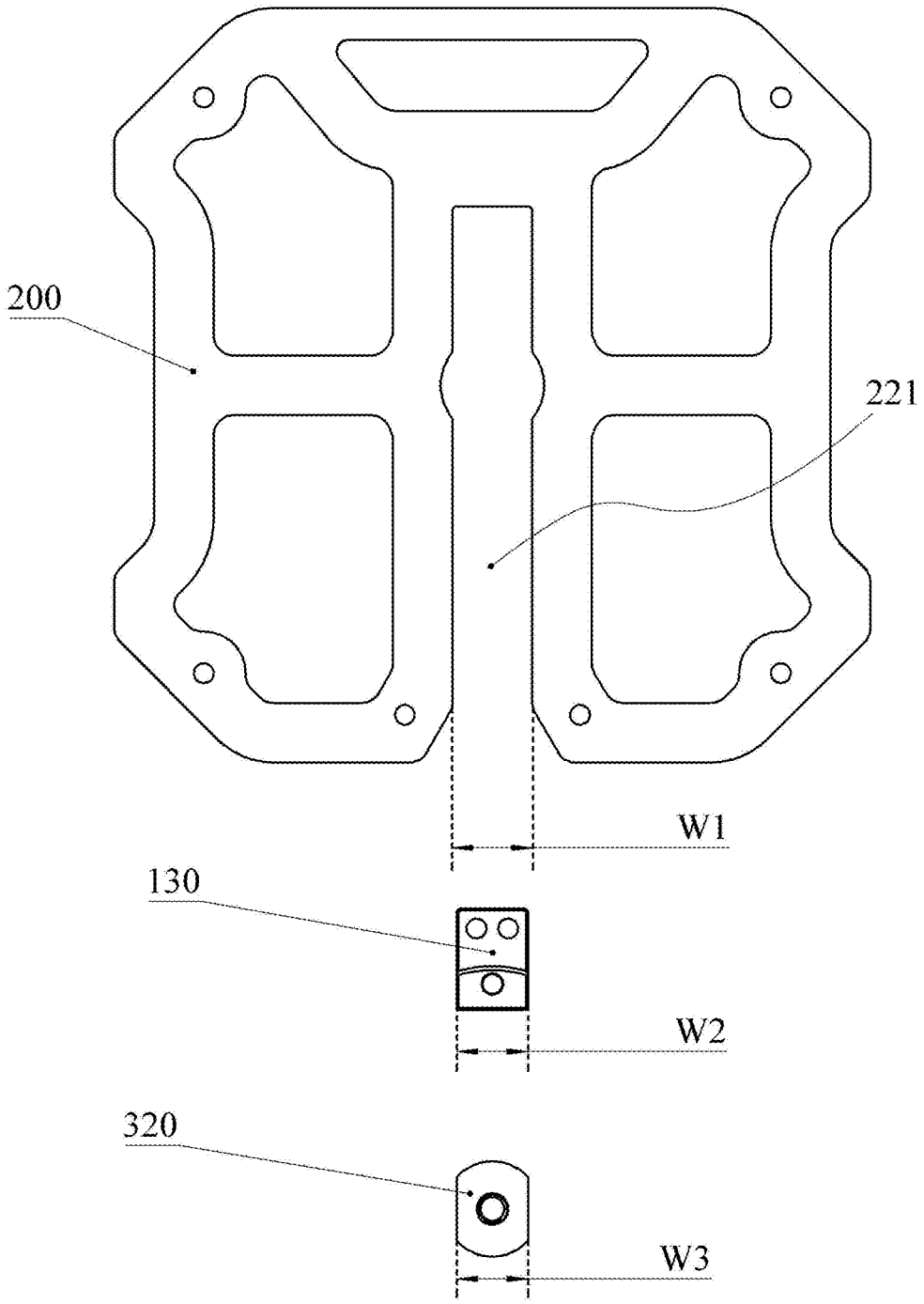
FIG. 12 is a front view of the weight plate, first connector, and limiting rod in the embodiment shown in FIG. 11.

As shown in FIGS. 1 and 12, the width W2 of the snap-fit slot 134 on the first connector 130 is configured to be no greater than the width W1 of the short slot 222 in the weight plate 200. Therefore, the weight plate 200 can be embedded in the snap-fit slot 134 by the limiting plate 2322, while the stop plate 133 of the snap-fit slot 134 is also embedded in the limiting slot 2325 (see FIG. 10), thus forming a fixed connection between the weight plate 200 and the fixing plate 120. This arrangement restricts the movement of the weight plate 200 and fixing plate 120 along the axial direction parallel to the length of the handle 100. At this point, the weight plate 200 is only allowed to detach from the fixing plate 120 by moving radially upwards along the direction perpendicular to the axial direction of the handle 100. Similarly, other weight plates 200 can also be restricted from moving along the axial direction of the handle 100 by embedding the limiting plate 2322 in the positioning slot 2326 of another weight plate and embedding the positioning plate 2323 in the limiting slot 2325, thereby limiting relative movement between the two weight plates 200 along the axial direction of the handle 100.

Figure 13:
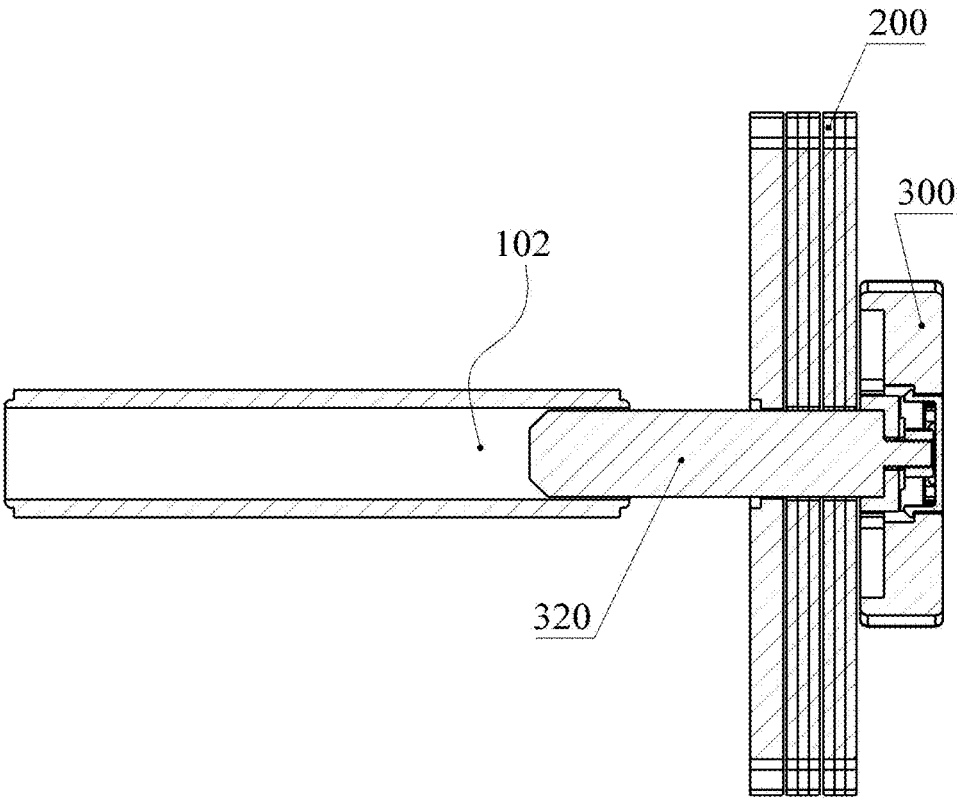
FIG. 13 is a schematic diagram of the connection between the knob, weight plate, and handle in the embodiment shown in FIG. 2.

As shown in FIG. 6, when multiple weight plates 200 and fixing plates 120 are assembled together, the first through-hole 102, the second through-hole 121, and the third through-hole 210 overlap to form a channel 1021. The limiting rod 320 of the knob 300 can be inserted into the channel 1021, and the end of the limiting rod 320 passes through the first through-hole 102 of the handle 100, thereby restricting the movement of the weight plate 200 along the radial direction of the handle 100 (see FIG. 13).

Figure 14:
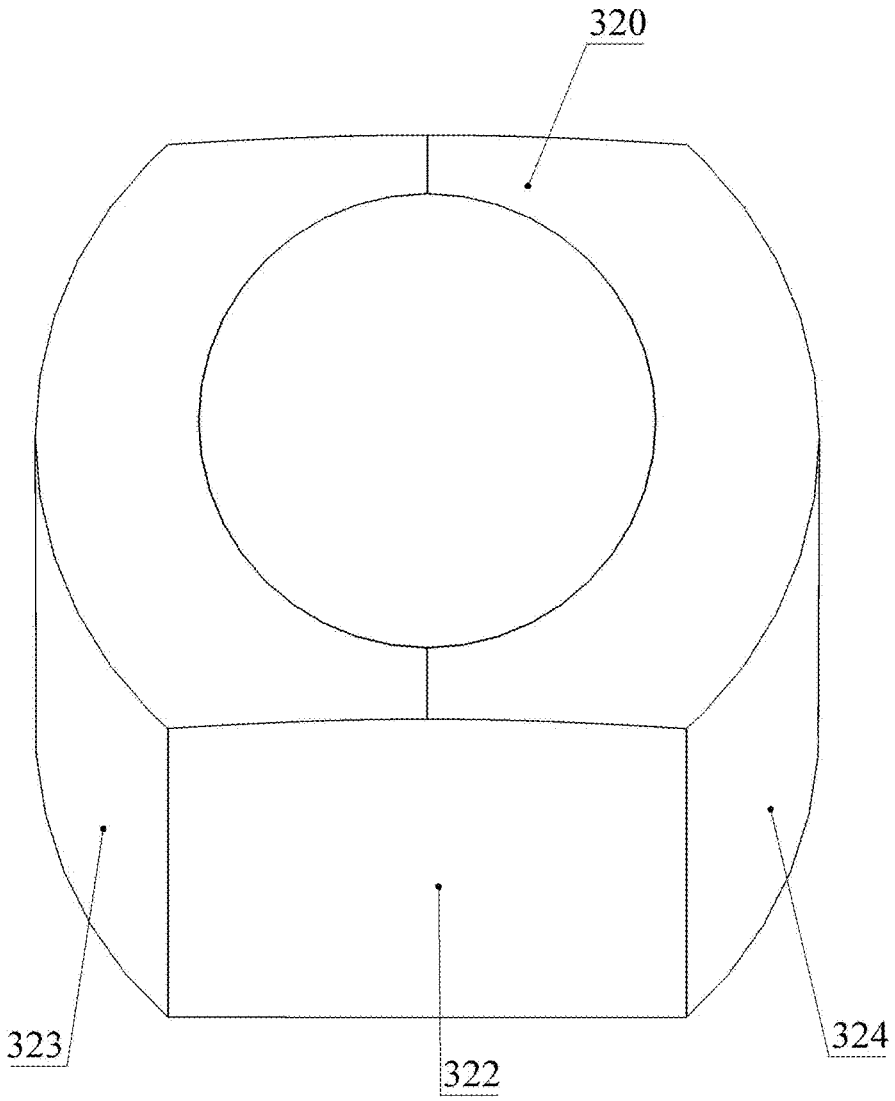
FIG. 14 is a cross-sectional schematic diagram of the limiting rod in the embodiment shown in FIG. 11.

As shown in FIG. 11, the knob 300 includes a main body 310, with a limiting rod 320 extending outward from the main body 310. The limiting rod 320 has a certain length, allowing it to accommodate multiple weight plates 200 along its length direction. The limiting rod 320 is provided with two opposite limiting surfaces and two opposite arc surfaces along its length direction, including a first limiting surface 321, a second limiting surface 322, a first arc surface 323, and a second arc surface 324 (see FIG. 14).

In some embodiments, the limiting rod adopts a telescopic sleeve structure with a multi-stage length adjustment function to accommodate a greater number of weight plates.

As shown in FIG. 12, a distance W3 is provided between the first limiting surface 321 and the second limiting surface 322. This distance W3 is substantially the same as the width W1 of the long slot 221 and short slot 222 of the weight plate 200, ensuring that when the weight plate 200 is inserted, the installation slot 220 can smoothly pass through the limiting rod 320 along the vertical direction. The first arc surface 323 and the second arc surface 324 have the same radius of curvature as the first through-hole 102 and the second through-hole 121 (see FIG. 14). Therefore, when the limiting rod 320 is inserted into the channel 1021 and rotated such that the first arc surface 323 and the second arc surface 324 come into contact with the curved inner wall of the second through-hole 121, the limiting rod 320 can restrict the movement of the weight plate 200 along the radial direction of the handle 100.

Figure 15:
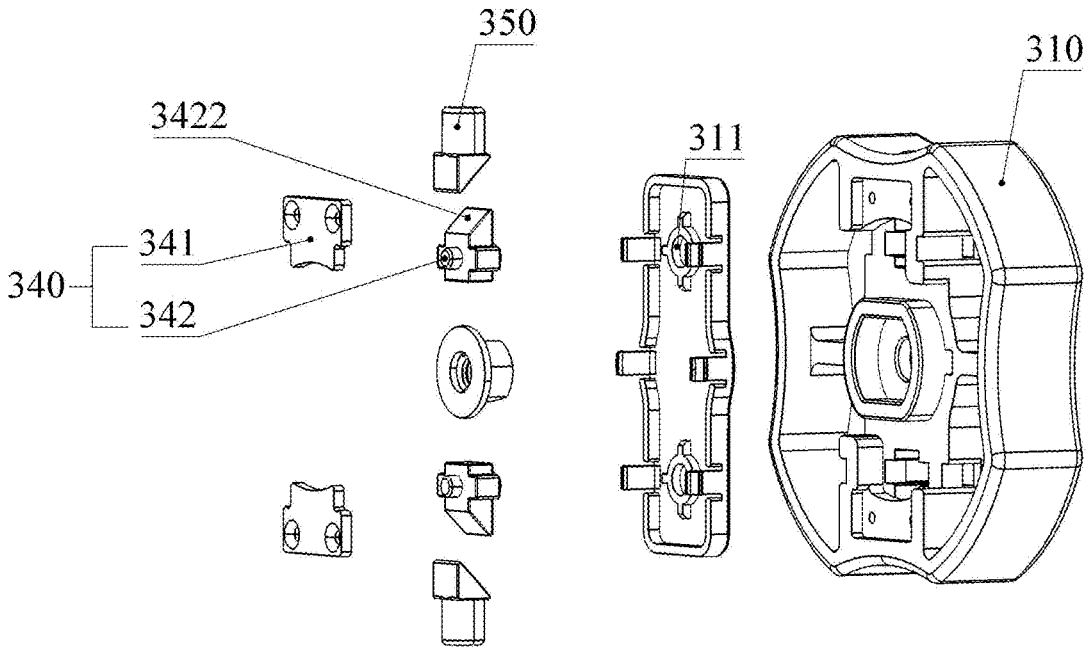
FIG. 15 is an exploded schematic diagram of the knob in the embodiment shown in FIG. 1.

As shown in FIG. 15, the main body 310 also includes a snap-fit structure 340. The snap-fit structure 340 includes a third insert plate 341 and a positioning protrusion 342. The third insert plate 341 can be embedded into the positioning slot 2326 of the weight plate 200 (see FIG. 9) to prevent the limiting rod 320 from moving along the axial direction of the handle, thereby locking the entire weight plate device. Additionally, the positioning protrusion 342 can be inserted into the positioning hole 2324 (see FIG. 9), forming a secondary lock with the positioning hole 2324. This enhances the fixed connection between the knob 300 and the weight plate 200, preventing the third insert plate 341 from detaching from the positioning slot 2326 during the user's workout and preventing the knob 300 from accidentally loosening.

Figure 16:
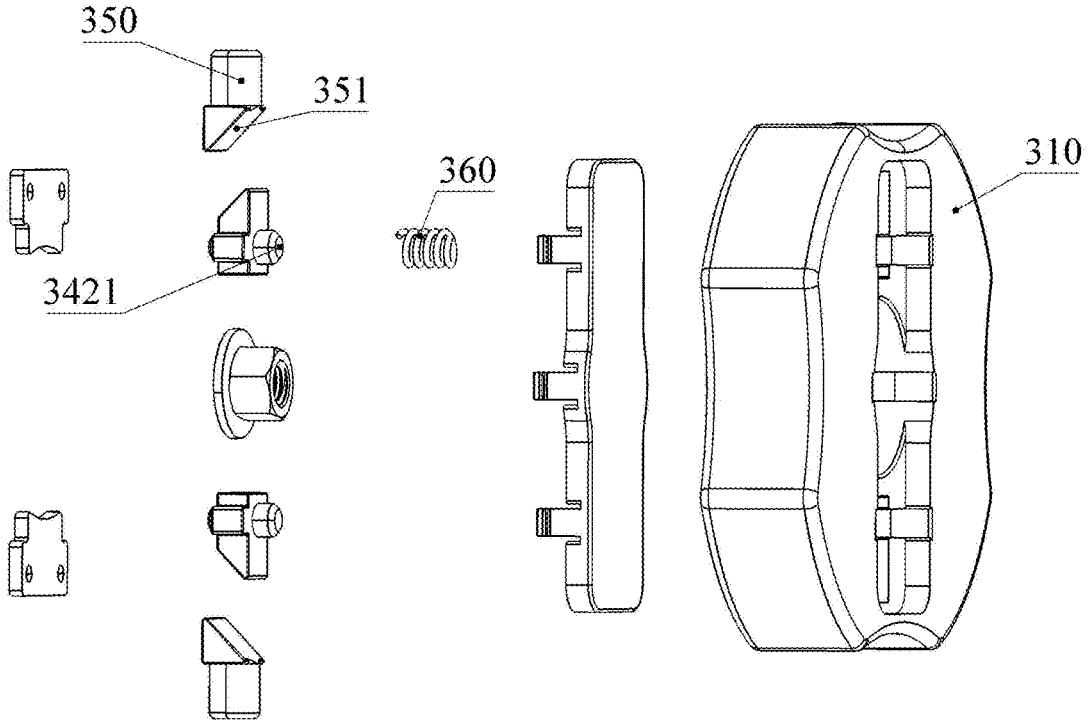
FIG. 16 is another exploded schematic diagram of the knob in the embodiment shown in FIG. 15.
Figure 17:
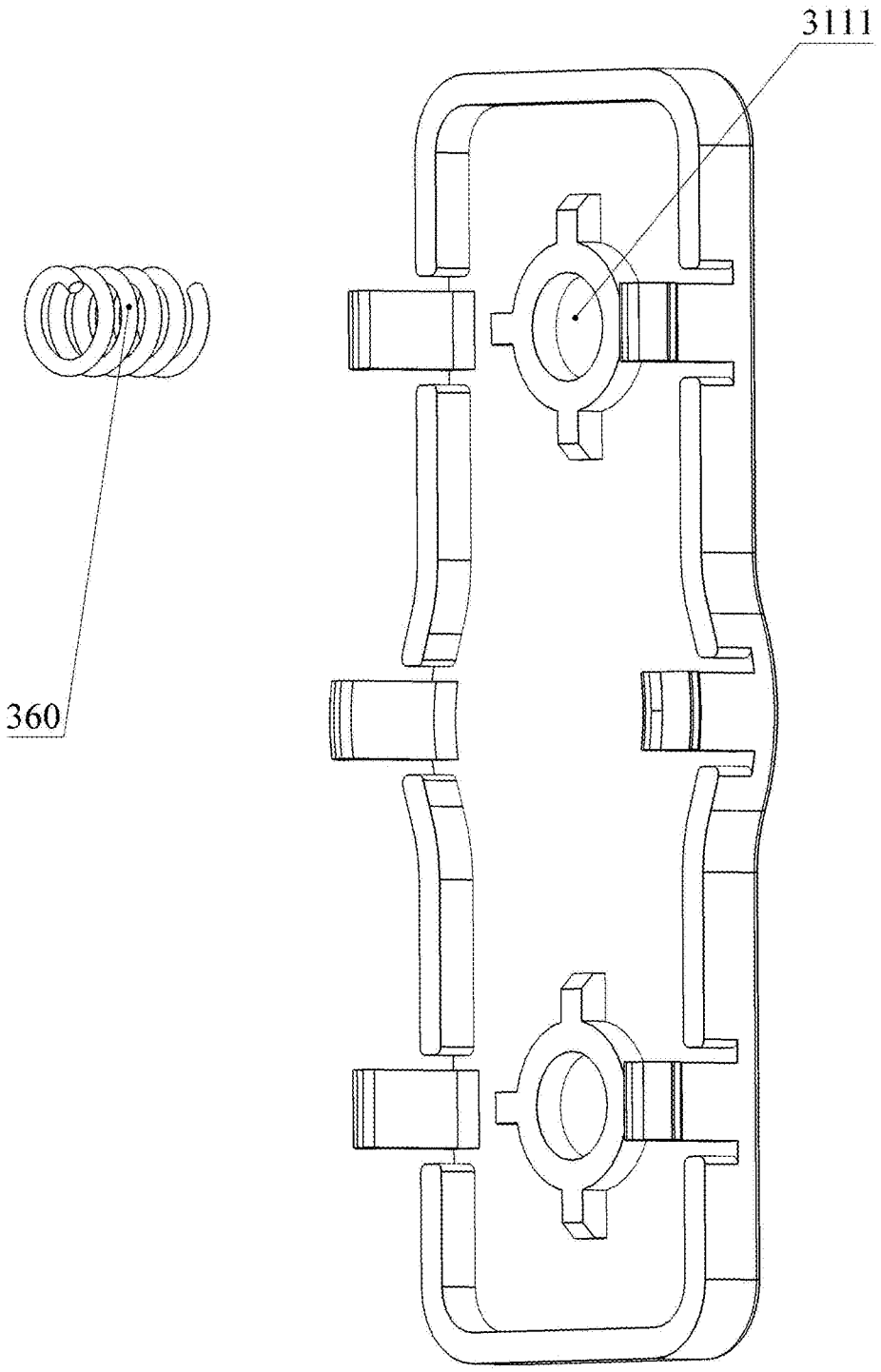
FIG. 17 is a schematic diagram of the position of the elastic component in the embodiment shown in FIG. 16.
Figure 18:
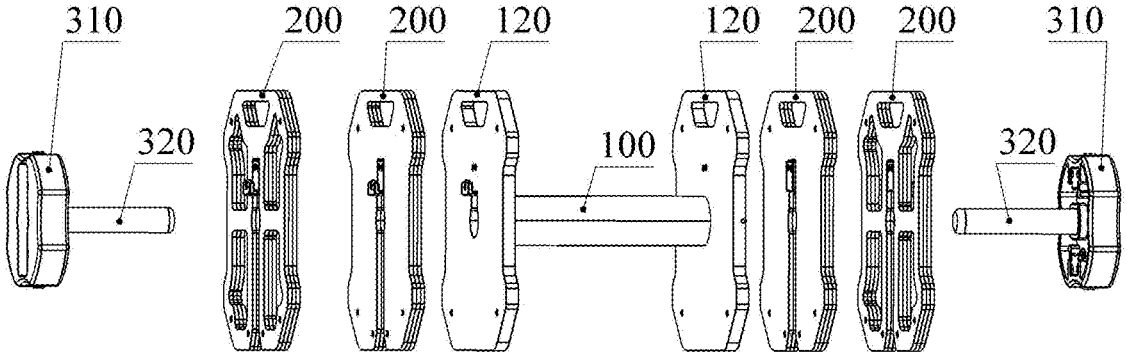
FIG. 18 is an overall exploded schematic diagram of the weight plate device in the embodiment shown in FIG. 1.

Specifically, as shown in FIGS. 15-17, in this embodiment, a sliding cavity 311 is provided on the main body 310, with the positioning protrusion 342 being arranged inside the sliding cavity 311. The upper part of the sliding cavity 311 is equipped with a button 350, with at least part of the button 350 protruding outside the main body 310. The rear wall surface 3421 of the positioning protrusion 342 is in contact with the bottom surface of the sliding cavity 3111 via an elastic component 360, allowing the positioning protrusion 342 to automatically rebound in the transverse direction along the length of the limiting rod 320, ensuring that the positioning protrusion 342 remains securely snapped into the positioning hole 2324 (see FIG. 9) in a timely manner.

In other embodiments (not shown in the figures), the reset structure formed by the elastic component 360 may be replaced by a gear structure, which controls the lateral extension and retraction of the snap-fit structure 340 through the rotation of the gear. This structure can provide more precise positioning control and enhance the locking effect between the knob 300 and the weight plate 200. Alternatively, the elastic component 360 can be omitted, and a magnetic attraction component can be added to the positioning protrusion 342 and the positioning slot 2326. Alternatively, a magnetic component can be placed on the positioning protrusion 342, while the positioning slot 2326 can be made from metal material. This approach not only simplifies the structure but also ensures that the positioning protrusion 342 can automatically rebound in the horizontal direction.

As shown in FIGS. 15 and 16, in this embodiment, the positioning protrusion 342 is further provided with a sloped surface 3422, and the button 350 is equipped with a reverse slope 351. The reverse slope 351 of the button 350 contacts the sloped surface 3422 of the positioning protrusion 342. When the button 350 is driven to move in the direction of the sliding cavity 311, the reverse slope 351 of the button 350 compresses the sloped surface 3422 of the positioning protrusion 342, causing the positioning protrusion 342 to move in the axial direction of the handle 100 within the sliding cavity 311. At this point, the movement direction of the positioning protrusion 342 is perpendicular to the driving direction of the button 350. When the button 350 returns to its initial position, the positioning protrusion 342 is driven back by the elastic force of the elastic component 360 to its original position, i.e., embedded into the positioning hole 2324 (see FIG. 9).

In other embodiments (not shown in the figures), a push-type telescopic locking structure may be used, where the button 350 is positioned on the side surface 301 of the knob 300 and controls the lateral displacement of the snap-fit structure 340 through a spring mechanism. When the user needs to replace the weight plate, pressing the button 350 causes the snap-fit structure 340 to move away from the positioning plate 2323, thereby releasing the positioning protrusion 342 from the positioning hole 2324. After the replacement is completed, pressing the button 350 again causes the snap-fit structure 340 to move towards the positioning plate 2323, re-locking the knob 300 to the weight plate 200. In other embodiments, the motion conversion mechanism between the button 350 and the positioning protrusion 342 may also include a gear transmission or linkage mechanism, which converts the longitudinal pressing motion of the button 350 into the axial movement of the positioning protrusion 342 along the handle 100.

The preferred embodiment of the present invention can be operated through the following method:

When the user needs to replace the weight plate, the first step is to press the button 350 downward. At this moment, the mechanical transmission of the button will drive the positioning protrusion 342 to slide along its length direction, away from the positioning hole 2324, thus completely disengaging from the restraint of the positioning hole 2324. After this unlocking action is completed, the user can rotate the knob 300 clockwise or counterclockwise by 90°, which drives the limiting rod 320 to undergo a key positional transformation. The first limiting surface 321 and the second limiting surface 322 of the limiting rod transition from their original locked state with the vertical wall of the long slot 221 to a release state parallel to the slot wall. At this point, the lateral constraint of the limiting rod on the weight plate 200 is fully released, allowing the user to pull the limiting rod 320 out by a certain distance, making it easy to remove the weight plate that needs adjustment in the vertical direction. After completing the weight replacement, the limiting rod 320 should be pushed toward the handle 100. Then, the button 350 is pressed again while simultaneously rotating the knob 300 back to its initial position. When the knob returns to the original position, the dual limiting surfaces of the limiting rod will lock back into a vertical alignment with the walls of the long slot 221. At this time, the button 350 is released, and the elastic component 360 will automatically drive the positioning protrusion 342 to precisely re-insert into the positioning hole 2324, thereby securing the remaining weight plate 200 in place and ensuring the stability and safety of the equipment during use.

In summary, the present invention achieves the following technical effects: The weight plate 200, through the design of the longitudinal plug-in fit with the third through-hole 210 and the installation slot 220, enables tool-free quick disassembly, significantly enhancing the efficiency of weight adjustment. The relative limiting surfaces of the limiting rod 320 precisely fit with the third through-hole 210 and the installation slot 220 of the weight plate 200, ensuring accurate longitudinal positioning of the weight plate and preventing installation difficulties caused by misalignment. Additionally, the snap-fit structure 340 of the elastic component 360, in conjunction with the gap fit between the positioning protrusion 342 and the positioning hole 2324, forms a secondary locking mechanism that effectively resists accidental unlocking due to vibration or unintended contact. Furthermore, the transmission design between the button 350 and the snap-fit structure 340 enables one-click unlocking of the weight plate device, making operation convenient.

The application of the present invention not only meets the user's demand for personalized weight adjustment of the weight plate device but also greatly simplifies the assembly and disassembly process, improving the market competitiveness and user satisfaction of the weight plate device. By implementing the above technical solution, the vertical plug-in weight plate device of the present invention is not only more compact and rational in structure but also significantly improved in terms of performance, providing fitness enthusiasts with a more efficient, safe, and comfortable user experience.

The technical solution described in the present invention is not limited to the field of dumbbells. Its unique design concept and structural principles are also applicable to barbells and kettlebells. In barbell applications, by adapting the core connection and adjustment structure of this solution to barbells, quick loading and unloading of the barbell plates can be achieved, effectively meeting the diverse weight requirements for different training intensities, significantly enhancing the flexibility and efficiency of training.

For kettlebells, considering their unique shape and usage characteristics, this technical solution has been integrated without altering the inherent feel of the kettlebell during use, enabling flexible adjustment of the kettlebell's weight. This expands the range of applicability of kettlebells during training.

In summary, the application extension of this technical solution can significantly enhance the functionality and practicality of various fitness equipment, effectively meeting the differentiated needs of fitness enthusiasts across different training programs, and holds high promotional and application value.

In the description of the present invention, it should be understood that positional terms such as "front, rear, top, bottom, left, right," "horizontal, vertical, perpendicular, parallel," and "top, bottom" typically refer to the positional relationships based on the orientation or location shown in the drawings. These terms are used solely for the convenience of describing the invention and simplifying the description. Unless otherwise stated, these positional terms do not indicate or imply that the devices or components referred to must have a specific orientation or be constructed and operated in a specific orientation, and therefore should not be construed as limiting the scope of the present invention. The positional terms "inside, outside" refer to the interior or exterior relative to the contour of each component itself.

For convenience of description, spatial relative terms such as "above," "above the surface of," "on top of," and "over" can be used to describe the spatial relationship between one device or feature and another, as shown in the drawings. It should be understood that the spatial relative terms are intended to encompass different orientations during use or operation, other than those described in the orientation depicted in the drawings. For example, if the device in the drawings is inverted, the device previously described as being "above other devices or structures" or "on top of other devices or structures" will then be positioned as "below other devices or structures" or "under other devices or structures." Therefore, the exemplary term "above" can encompass both "above" and "below." The device may also be positioned in other different ways (rotated 90 degrees or oriented differently), and the spatial relative descriptions used here should be interpreted accordingly.

Furthermore, it should be noted that the use of terms such as "first," "second," etc., to distinguish components is solely for the purpose of distinguishing between the respective components. Unless otherwise stated, these terms do not carry any special meaning and should not be construed as limiting the scope of protection of the present invention.

The above-described embodiments are merely preferred examples of the present invention and are not intended to limit the invention. Those skilled in the art will understand that various modifications and changes may be made to the invention. Any modifications, equivalent substitutions, improvements, or the like made within the spirit and principles of the present invention should be included within the scope of the invention's protection.

The invention claimed is:

1. A vertical plug-in weight plate device, comprising:

a handle, multiple weight plates, and a knob; and fixing plates securely attached at respective ends of the handle;

wherein each of the fixing plates comprises an axial through-hole, and wherein each of the fixing plates includes a first connector that is equipped with a snap-fit slot;

wherein each of the multiple weight plates includes:

a through-hole located at a center of the respective weight plate, along with an installation slot extending from the through-hole toward both sides, wherein the installation slot consists of a long slot that passes through an edge of the respective weight plate and a short slot that terminates at an edge of the respective weight plate; and a second connector placed within the short slot, wherein the second connector is designed with a limiting slot and a positioning slot, allowing for lateral interlocking with an adjacent weight plate or the first connector of a respective fixing plate of the fixing plates, wherein the positioning slot is equipped with a positioning hole;

wherein the knob includes:

a limiting rod, which passes through the axial through-holes of the respective fixing plate and the through-hole of each of the multiple weight plates, wherein a cross-section of the limiting rod features a limiting surface that aligns with a width of the long slot of each of the multiple weight plates and a curved surface that matches an inner wall of the through-hole of each of the multiple weight plates, wherein the limiting rod is configured to restrict a longitudinal movement of the multiple weight plates along an axis of the limiting rod; and a snap-fit structure, wherein the snap-fit structure includes an insert plate and a positioning protrusion, where the insert plate forms a snap-fit with the positioning slot of the second connector of a weight plate of the multiple weight plates, wherein the positioning protrusion is configured to be driven by an elastic element and engage with the positioning hole of the positioning slot of the second connector of a weight plate of the multiple weight plates to create a resettable rotational lock, preventing accidental rotation of the limiting rod.

2. The vertical plug-in weight plate device as described in claim 1, wherein each of the first connectors includes a shared wall, and a first insert plate and a stop plate extending from respective ends of the shared wall, forming a U-shaped snap-fit slot between the first insert plate, the shared wall, and the stop plate.

3. The vertical plug-in weight plate device as described in claim 2, wherein a thickness of the stop plate is the same as a width of the limiting slot, and when the first connector and the second connector form a lateral interlock, the stop plate and the limiting slot form a transitional fit.

4. The vertical plug-in weight plate device as described in claim 1, wherein the limiting slot is a reverse U-shaped limiting slot;

wherein the positioning slot is a U-shaped positioning slot;

wherein the second connector comprises a positioning block;

wherein the positioning block includes a common wall, with a limiting plate and a positioning plate extending from each end of the common wall, wherein the reverse U-shaped limiting slot is formed between the limiting plate and the common wall, and the U-shaped positioning slot is formed between the positioning plate and the common wall.

5. The vertical plug-in weight plate device according to claim 4, wherein a thickness of the limiting plate is the same as a width of the positioning slot, and a thickness of the positioning plate is the same as a width of the limiting slot, wherein when two weight plates of the multiple weight plates are laterally interlocked through the respective second connectors, a transitional fit is formed between the limiting plate and the positioning slot of the respective second connectors, as well as between the positioning plate and the limiting slot of the respective second connectors.

6. The vertical plug-in weight plate device as described in claim 1, wherein each of the fixing plates is fixedly connected to the handle by welding.

7. The vertical plug-in weight plate device as described in claim 1, wherein the first connector of each of the fixing plates is molded as a part of the respective fixing plate using an integrated casting process.

8. The vertical plug-in weight plate device as described in claim 1, wherein the second connector is a split-type structure, comprising a second insert plate and a positioning block, wherein the second insert plate is positioned within the short slot and extends from the short slot towards the long slot, and is fixedly connected to the positioning block via a fastener.

9. The vertical plug-in weight plate device as described in claim 1, wherein the second connector of each of the multiple weight plates is molded as a part of the respective weight plate using an integrated casting process.

10. The vertical plug-in weight plate device according to claim 1, wherein one of the positioning holes or the positioning protrusion is provided with a magnetic component, while the other is provided with a metal component.

* * * * *